United States Patent [19]

Anderson

[11] Patent Number: 4,937,410

[45] **Date of Patent: * Jun. 26, 1990**

[54] BAG FOR CONTAINING EDIBLES DURING MICROWAVE COOKING

[76] Inventor: Alan R. Anderson, 707 Pheasant Run, West Chester, Pa. 19382

[ * ] Notice: The portion of the term of this patent subsequent to Mar. 7, 2006 has been disclaimed.

[21] Appl. No.: 329,012

[22] Filed: Mar. 27, 1989

[51] Int. Cl.[5] ..... H05B 6/80; B65D 81/34

[52] U.S. Cl. ..... 219/10.55 E; 426/107; 426/234; 426/111; 426/241; 99/DIG. 14; 229/DIG. 3; 206/632

[58] Field of Search ..... 219/10.55 E, 10.55 F, 219/10.55 M; 426/107–115, 234, 241, 242, 243; 206/632; 383/123; 99/DIG. 14, 323.4, 323.5; 229/DIG. 3, 903, 905, 906

[56] References Cited

U.S. PATENT DOCUMENTS

| | | | |
|---|---|---|---|
| 2,865,768 | 12/1958 | Barnes et al. | 426/111 |
| 3,834,528 | 9/1974 | Pickford et al. | 229/DIG. 3 |
| 3,973,045 | 8/1976 | Brandberg et al. | 426/110 |
| 4,038,425 | 7/1977 | Brandberg et al. | 426/107 |
| 4,219,573 | 8/1980 | Borek | 426/107 |
| 4,292,322 | 9/1981 | McHam | 426/111 |
| 4,361,235 | 11/1982 | Gautier | 426/110 |
| 4,450,180 | 5/1984 | Watkins | 426/107 |
| 4,461,031 | 7/1984 | Blamer | 383/123 |
| 4,503,559 | 3/1985 | Warnke | 383/40 |
| 4,553,010 | 11/1985 | Bohrer et al. | 219/10.55 E |
| 4,563,561 | 1/1986 | Vaeth et al. | 219/10.55 E |
| 4,571,337 | 2/1986 | Cage et al. | 426/107 |
| 4,584,202 | 4/1986 | Roccaforte | 426/111 |
| 4,640,838 | 2/1987 | Isakson et al. | 426/107 |
| 4,810,844 | 3/1989 | Anderson | 219/10.55 E |

*Primary Examiner*—Philip H. Leung

*Attorney, Agent, or Firm*—Woodcock Washburn Kurtz Mackiewicz & Norris

[57] ABSTRACT

This invention relates to bags suitable for containing edible components during microwave cooking. The bags may serve as shelf-stable packages for the uncooked edible components as well as containers for the edible components during microwave cooking. The bag comprises two opposing side panels and an inwardly pleated bottom panel between the opposing side panels. Sections of the side panels may be seamed or bonded to sections of the bottom panel so that the inside surface area of the bottom panel is substantially less than the outside surface area of said bottom panel. The side panels are also joined along one side edge and the top edge, leaving an opening on one side. In one embodiment, self close ties are provided by slitting the bag in the area joining the side panels to the bottom panel. In another embodiment, a funnel opening to the bag is provided by means of an appropriately configured seal or bond between the side panels.

16 Claims, 2 Drawing Sheets

BAG FOR CONTAINING EDIBLES DURING MICROWAVE COOKING

RELATED APPLICATIONS

This application is related to U.S. Ser. No. 126,366, filed on Nov. 30, 1987, for "Microwave Popcorn Package" now U.S. Pat. No. 4,810,844, issued Mar. 7, 1989.

BACKGROUND OF THE INVENTION

Recent years have seen an explosion in the popularity of microwave cooking and of foods packaged in containers especially adapted for such cooking. One of the earliest successes in this area was microwavable popcorn packaged in microwavable packages, and numerous patents have been issued on such packages. See, for example, U.S. Pat. Nos. 3,973,045, 4,038,425, 4,219,573, 4,292,332, 4,450,180, 4,548,826, 4,461,031, 4,503,559, 4,553,010, 4,678,882, 4,571,337, and 4,584,202.

Until recently, there had been only limited success in cooking meat products by microwave, in part because of the difficulties in browning or crisping a food product in a microwave oven. In some instances, microwave susceptor materials have been incorporated into cooking packages or containers for the foods to enhance browning or crisping. New product formulations for foods may also include special spice or bread coatings or sauces which can be combined with meat products to provide an appetizing product when the meat product is cooked by microwave even in the absence of browning or crisping. The packaged products might include, for example, a suitable microwave cooking package and a sauce or spice mixture to which the consumer adds a meat product. The sauce or spice mixture and the meat product are combined in the microwave cooking package, and the entire package is placed in the microwave oven.

With the development of such new combination products has come a need for specially adapted packaging products. Ideally, such packages should be easily manufactured, should not add substantial cost to the overall product. In those instances in which an edible component (such as a spice or sauce mixture) is sold with the bag, the bags should ideally be suitable not only for packaging the edible component under shelf-stable conditions, but also for containing the entire edible component during microwave cooking. The package should also preferably provide conveniences such as a heat-resistant handle for easy handling and a self-embodied closing means. Finally, the package should be adaptable to a wide variety of microwavable foods, not only the combination products described above but also popular microwavable foods such as popcorn.

SUMMARY OF THE INVENTION

A new bag configuration has now been developed which provides a convenient package for microwavable foods. In one embodiment of this invention, the bag comprises two opposing side panels, each having top and first and second side edges, and an inwardly pleated bottom panel between said opposing side panels. The top and first side edges of the side panels are joined to one another, but at least a portion of the second side edges of the side panels are not joined to one another to provide an opening for the bag. The first and second side edges of the side panels adjacent to the inwardly pleated bottom of the bag are joined to the side edges of the inwardly pleated bottom. Preferably, portions of the opposing side panels are further joined to portions of the bottom panel so that the inside surface area of the bottom panel is substantially less than the outside surface of the bottom panel. The bag is formed from a material substantially transparent to microwave energy and capable of withstanding temperatures reached during the microwave cooking of an edible component contained therein. When an edible component is placed in the bag, on the inside surface of the bottom panel, the bag is able to stand upright.

In another embodiment of the invention, the bag once again comprises two opposing side panels, each having a top and first and second outside edges, and an inwardly pleated bottom panel between the opposing side panels. As in the previous embodiment, the side panels are joined to one another at their top and first side edges. The side panels are further joined to one another in a sealed portion adjacent to their top and second side edges, the seal being configured so as to provide a funnel opening to the bag. Also, as in both previous embodiments, the first and second side edges of the side panels adjacent to the inwardly pleated bottom of the bag are joined to the side edges of the inwardly pleated bottom, and, preferably, portions of the opposing side panels are further joined to portions of the bottom panel so that the inside surface area of the bottom panel is substantially less than the outside surface of the bottom panel.

DETAILED DESCRIPTION OF THE INVENTION

This invention will be described in greater detail below in reference to FIGS. 1 to 7 which illustrate microwave cooking bags constructed in accordance with this invention. In these figures the bag is illustrated as being formed from a visible light-transparent material; however, non-transparent materials such as paper may also be utilized. The material from which the bag is formed must be flexible, substantially transparent to microwave energy and must be able to withstand the high temperatures reached during the microwave cooking of various edible components, e.g., up to about 370° F. The material from which the bag is made is also preferably impervious to the various cooking oils or fats which may comprise a portion of the edible components. Examples of suitable materials include films of polyesters, such as polyethylene terephthalate, polyolefins such as polypropylene, polycarbonates and nylon. An especially preferred film is polyethylene terephthalate film coated on one side with a copolyester that allows for heat sealing. Suitable materials would also include paper which may treated to improve its imperviousness to oils and liquids by, for example, lamination to the above-mentioned films, coating with polypropylene, or treatment with materials such as fluoropolymers. From a packaging standpoint, it is advantageous if the material from which the bag is made provides sufficient water and vapor permeability to allow for a long shelf life of the packaged ingredients. If the bag is not made from such a barrier material as, for example, a paper bag, it may be overwrapped with a barrier material such as polyvinylidine chloride (saran) film to provide barrier protection. The overwrap would be removed by the consumer prior to placing the bag in the microwave oven.

Figure 1:
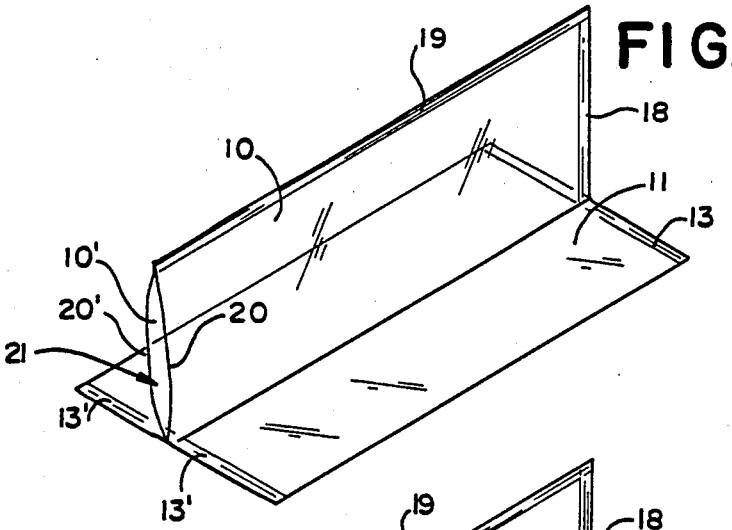
FIGS. 1, 2, 3, 4 and 5 are perspective views of microwave cooking bags according to this invention.
Figure 2:
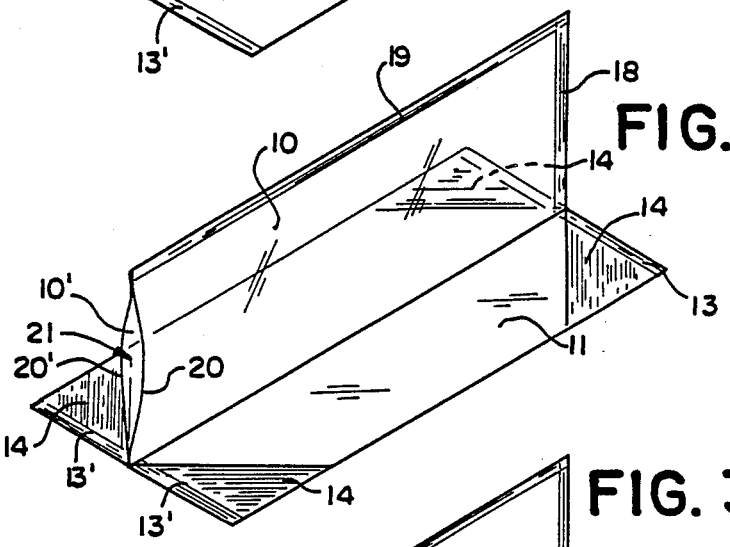

Referring to all of the figures, they show a bag according to this invention having two opposing side panels 10 and 10' connected to a bottom panel 11 having an inward pleat or gusset 17. In the preferred embodiments, as illustrated in FIGS. 2–5, the bottom panel 11 has an inside surface area substantially smaller than its outside surface area. This is achieved by bonding or seaming sections of side panels 10 to sections of bottom panel 11 in areas 14. As embodied in the specific packages illustrated in the figures, the areas 14 are triangular, leaving bottom 11 with an inside surface roughly in the shape of a hexagon. To provide a bag in which the inside surface area of the bottom panel is substantially smaller than the outside surface area of the panel, it will generally be desired to join or bond sections of side panels 10 to bottom panel 11 so as to "cut off" the corners of bottom panel 11, as illustrated in the figures. Other means for bonding side panels 10 to bottom 11 may also be feasible, however, the only limiting factor being that bottom panel 11 retain a surface area sized and configured so as to permit edible components to be placed on it. Advantages accruing from this configuration include the ability to mass edible components together for more efficient cooking, the elimination of sharp corners in which edible components can get stuck, and the provision of bonded areas 14 which can provide a source for self-close ties as discussed further hereinbelow. In other embodiments of the invention, however, as illustrated in FIG. 1, the inside surface area of the bottom panel 11 is no different from its outside surface area.

In the above-mentioned preferred embodiment, the inside surface area of bottom panel 11 is generally substantially smaller than the outside surface area of bottom panel 11. It is not possible to define the exact extent to which the inside surface area of bottom panel 11 will differ from the outside surface area of said panel, the preferred bag configuration depending and varying based on the its ultimate use, but it is estimated that the inside surface will generally be about 80 to 93%, preferably about 85%, of the outside surface area of the bottom panel. The bag could be configured so that the inside surface area of the bottom panel is even less than 80% of the outside surface area; however, there are no advantages to such configurations and they tend to waste film or other package material. The differences in surface area will vary according to the shape of the bag and the amount of edible component placed therein.

Figure 3:
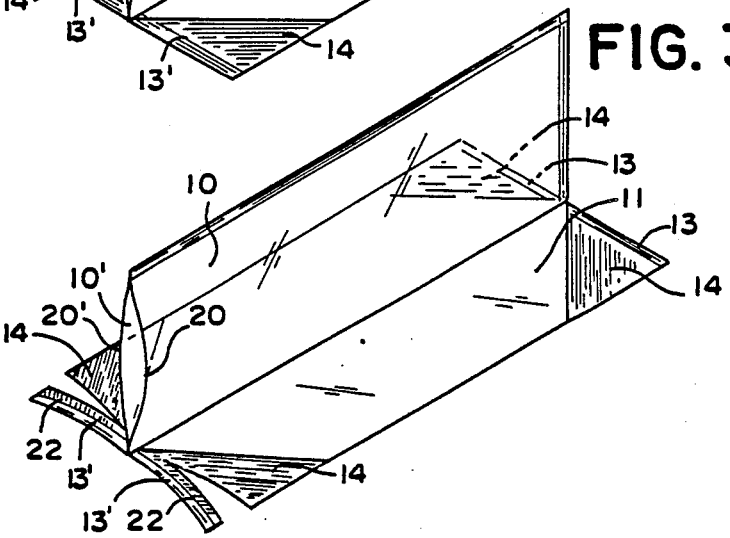
Figure 4:
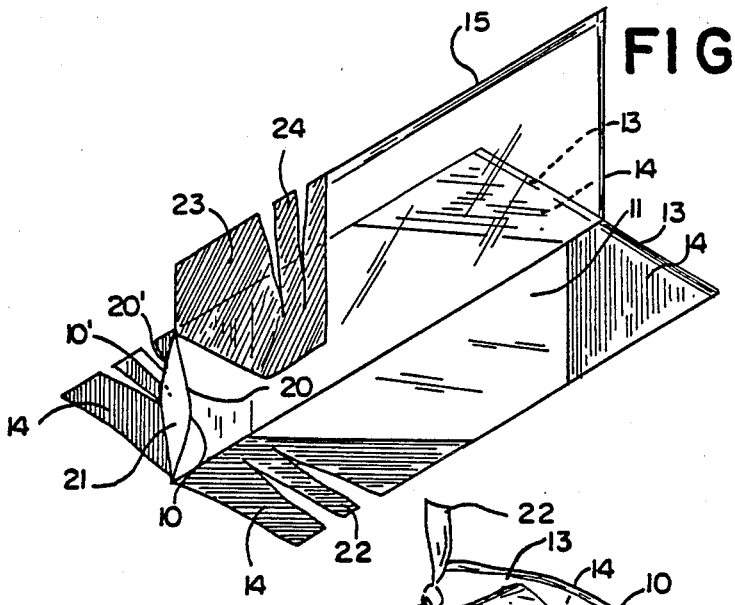
Figure 5:
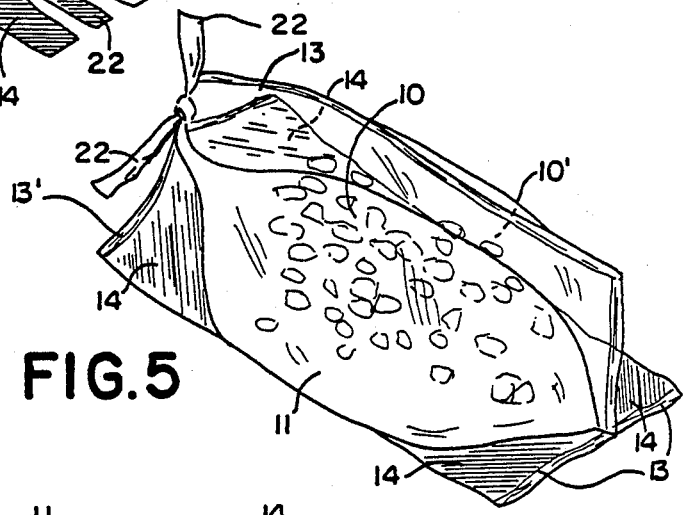
Figure 7:
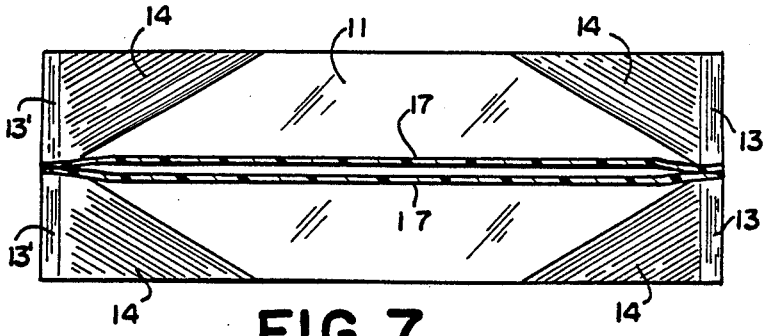
FIG. 7 is a perspective view of the bottom of the bag of FIG. 2.
Figure 6:
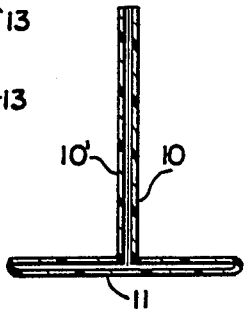
FIG. 6 is a cross-sectional view of a bag of this invention.

In the embodiments of FIGS. 1 to 5, side panels 10 and 10' are joined to one another at their first side edges in seam 18 and along their top edges in seam 19. Side panels 10 and 10' are, as in the previous embodiment, joined to bottom panel 11 at seams 13 and 13'. At least a portion of second side edges 20 and 20', of side panels 10 and 10', respectively, are not joined to one another to provide an opening for the bag, 21. As shown in FIG. 3, the area 14, at which side panels 10 and 10' are further bonded to bottom panel 11, may be slit to provide self-closing ties 22 for the bag. As shown in FIG. 5, once an edible component is placed in the bag, ties 22 may be tied to temporarily close the bag during cooking.

In a further modification of the bag of this invention, as illustrated in FIG. 4, side panels 10 and 10' may be further joined in a sealed portion 23 adjacent to their top and second side edges, 15 and 20, the sealed portion 23 being configured so as to provide a funnel opening 21 to said bag, especially useful for filling said bag with pourable components. Slits in sealed areas 14 provide self closing ties 22.

When edible components are placed inside the bag of this invention, the bag is capable of standing substantially upright with the edible component resting on the inside surface of bottom panel 11. When the bag is placed in a microwave oven and exposed to microwave energy, hot liquid from the edible component contained therein may spatter on the sides of the bag, making the bag difficult to handle. Seams 18 and 19 advantageously provide convenient "handles" for holding the bag and removing it from the microwave oven and dispensing food therefrom.

In some instances, it may be desired, in order to improve cooking efficiency, to place inside the bag of this invention a microwave interactive material capable of converting a portion of the incident microwave energy to heat. Examples of suitable microwave interactive materials are known in the art, e.g., U.S. Pat. No. 4,190,757 to Turpin et al., U.S. Pat. No. 3,783,220 to Tanizaki, U.S. Pat. No. 4,290,924 to Brastad et al. and U.S. Pat. No. 4,283,427 to Winters et al. The generally preferred microwave interactive material is lightly metallized polyethylene terephthalate film which can be laminated, for example, to Kraft paper, paper board or polyester film, and placed, metallized surface up, on the inside surface of bottom panel 11. In another embodiment, the bag may be formed from a laminate of two layers of paper, with the susceptor material contained between said layers of paper and placed in bottom panel 11.

The bags of this invention may be easily manufactured on standard make and fill machines. A continuous web of material, such as the aforementioned polyethylene terephthalate film coated with a heat and pressure sensitive material, is folded longitudinally to create an inwardly directed pleat or gusset. At this point, a cross-sectional view of the web of material would show a W-shaped configuration. Heat and pressure are applied to the web at appropriate intervals to create heat seals between opposite panels of the web. The heat seals are configured so as to create a continuous length of bags, joined to one another at adjacent side seams.

The edible component which may be packaged in the bags of this invention may be any food capable of being cooked by microwave. Examples include various meat products, e.g., pork, chicken, beef, and barbeque, sauces such as spaghetti sauce, vegetables such as tomatoes and peppers, and snacks such as popcorn and pork rinds.

What is claimed is:

1. A bag suitable for holding an edible component during microwave cooking comprising two opposing side panels each having top and first and second side edges;

an inwardly pleated bottom panel between said opposing side panels;

said side and bottom panels comprising a material substantially transparent to microwave energy and capable of withstanding temperatures reached during the microwave cooking of said edible component in said bag;

the top and first side edges of each said side panel being joined to the top and first side edges of said other side panel, at least a portion of the second side edges of said side panels not being joined to one another to provide an opening for said bag;

the first and second side edges of said side panels adjacent to the inwardly pleated bottom panel being joined to the side edges of said inwardly pleated bottom panel.

2. The bag of claim 1 wherein portions of said opposing side panels are joined to portions of said bottom panel so that the inside surface area of said bottom panel is substantially less than the outside surface area of said bottom panel.

3. The bag of claim 2 in which the inside surafce area of said bottom panel is about 80 to 93% of the outside surface of said panel.

4. The bag of claim 1 wherein the portions of said bag at which portions of said opposing side panels are joined to portions at said bottom panel are slit to provide self-close ties for said bag.

5. The bag of claim 1 in which said panels comprise a material selected from the group consisting of paper and films of polyesters, polyolefins, polycarbonates and nylon.

6. The bag of claim 5 in which said panels comprise a polyethylene terephthalate film.

7. The bag of claim 1 in which said panels comprise paper laminated to a film selected from the group consisting of polyester, polyolefins, polycarbonate and nylon films.

8. The bag of claim 1 in which said side panels are joined to one another and to said bottom panel by heat seals.

9. A bag suitable for holding an edible component during microwave cooking comprising two opposing side panels each having top and first and second side edges;

an inwardly pleated bottom panel between said opposing side panels;

said side and bottom panels comprising a material substantially transparent to microwave energy and capable of withstanding temperatures reached during the microwave cooking of said edible component therein;

and side panels being joined to one another at their top and first side edges;

said side panels being further joined to one another at their top and first side edges;

said side panels being further joined to one another in a sealed portion adjacent to their top and second side edges, said seal being configured so as to provide a funnel opening to said bag;

the side edges of said side panels adjacent to the inwardly pleated bottom panel being joined to the side edges of said inwardly pleated bottom panel.

10. The bag of claim 9 wherein portions of said opposing side panels are joined to portions of said bottom panel so that the inside surface area of said bottom panel is substantially less than the outside surface area of said bottom panel.

11. The bag of claim 10 in which the inside surface area of said bottom panel is about 80 to 93% of the outside surface of said panel.

12. The bag of claim 9 wherein the portion of said bag at which portions of said opposing side panels are joined to portions of said bottom panel are slit to provide self-close ties for said bag.

13. The bag of claim 9 in which said panels comprise a material selected from the group consisting of paper and films of polyesters, polyolefins, polycarbonates, and nylon.

14. The bag of claim 13 in which said panels comprise a polyethylene terephthalate film.

15. The bag of claim 9, in which said panels comprise paper laminated to a film selected from the group consisting of polyester, polyolefins, polycarbonate and nylon films.

16. The bag of claim 9 in which said side panels are joined to one another and to said bottom panel by heat seals.

* * * * *

UNITED STATES PATENT AND TRADEMARK OFFICE

CERTIFICATE OF CORRECTION

PATENT NO. : 4,937,410

DATED : June 26, 1990

INVENTOR(S) : Alan R. Anderson

It is certified that error appears in the above-identified patent and that said Letters Patent is hereby corrected as shown below:

Column 5, line 21: "at" should be --of--.

Signed and Sealed this

Eighteenth Day of June, 1991

*Attest:*

*Attesting Officer*

HARRY F. MANBECK, JR.

*Commissioner of Patents and Trademarks*